US005738048A

United States Patent [19]

Suzuki et al.

[11] Patent Number: 5,738,048

[45] Date of Patent: Apr. 14, 1998

[54] COOLING APPARATUS FOR COOLING AN ENGINE

[75] Inventors: Kazutaka Suzuki; Yasutoshi Yamanaka, both of Kariya; Yoshimitsu Inoue, Toyoake; Hiroyuki Fukunaga, Nishio, all of Japan

[73] Assignees: Denso Corporation, Kariya; Nippon Soken, Inc., Nishio, both of Japan

[21] Appl. No.: 791,776

[22] Filed: Jan. 29, 1997

[51] Int. Cl.[6] ..... F01P 7/14

[52] U.S. Cl. ..... 123/41.1; 123/41.13

[58] Field of Search ..... 123/41.1, 41.13

[56] References Cited

FOREIGN PATENT DOCUMENTS 7-083052 3/1995 Japan .
7-127752 5/1995 Japan .

*Primary Examiner*—Noah P. Kamen
*Attorney, Agent, or Firm*—Cushman Darby & Cushman IP Group of Pillsbury Madison & Sutro LLP

[57] ABSTRACT

According to the present invention, the cooling apparatus is equipped with a thermostat for opening or closing a water passage between a radiator and a water-cooled engine and a cooling water passage switching valve for switching a water introducing passage for introducing the cooling water around a thermosensitive member of the thermostat. When the engine is in a high-load operating condition and when the temperature of the cooling water is equal to or higher than a predetermined temperature, the cooling water immediately after having flowed out of the water-cooled engine flows into around the thermosensitive member of the thermostat by the operation of the cooling water passage switching valve. As a result, the thermostat is operated in response to the temperature of the high temperature cooling water having flowed out of the water-cooled engine, and the set temperature of the cooling water by the thermostat can be shifted to a lower temperature. In this way, it is possible to prevent preferably an excessive rise in the temperature of the cooling water not only when the engine is in a high-load operating condition but also when the engine is in a state of hot soak such as in idling after the vehicle has travelled on an upward slope with a low speed.

14 Claims, 4 Drawing Sheets

COOLING APPARATUS FOR COOLING AN ENGINE

CROSS REFERENCE TO THE RELATED APPLICATION

This application is based on and claims priority of Japanese Patent Application No. Hei. 8-20236 filed on Feb. 6, 1996, the content of which are incorporated herein by reference.

BACKGROUND OF THE INVENTION

1. Field of the Invention

The present invention relates to a cooling apparatus which can prevent an abnormal rise in the temperature of the cooling water in a water-cooled type engine (internal combustion engine) for a vehicle or the like.

2. Description of the Related Art

Conventionally, the temperature of the cooling water for cooling a water-cooled type engine for a vehicle is controlled by adjusting the flow amount of the cooling water flowing through a radiator for radiating heat by means of a thermostat which moves in response to the temperature of the cooling water. When the temperature of the cooling water is controlled, in order to reduce the fuel consumption of the engine, it is preferable to decrease the frictional resistance of the engine at a time of a low-load operating condition of the engine, by setting the temperature of the cooling water high. On the other hand, at a time of a high-load operating condition of the engine, it is preferable to set the temperature of the cooling water low in order to suppress the occurrence of a knocking and to increase the output power of the engine by improving the charge efficiency of the intake air.

For this reason, in JP-A-7-127752, at a time of a low-load operating condition of the engine, the low temperature cooling water which has been cooled by the radiator flows into a thermosensitive portion of the thermostat. When the temperature of the cooling water located on an outlet side of the radiator increases up to a thermostat set temperature, a valve portion of the thermostat is opened and the cooling water flows through the radiator. As a result, the set temperature of the engine cooling water by the thermostat can be shifted substantially to a higher temperature.

Also, at a time of a high-load operating condition of the engine, the high temperature cooling water before being cooled by the radiator flows into the thermosensitive portion of the thermostat. When the temperature of the cooling water before being cooled by the radiator increases up to the thermostat set temperature, the valve portion of the thermostat is opened and the cooling water flows through the radiator. As a result, the timing when the valve portion of the thermostat is opened becomes earlier than at a time of the low-load operating condition of the engine, with the result that the set temperature of the engine cooling water by the thermostat can be shifted substantially to a lower temperature.

In the apparatus described JP-A-7-127752, a state where the engine is in a hot soak (the idling operation after the high-load operation) after the vehicle has travelled on a upward slope with a low-speed will be described specifically. When the vehicle is travelling on an upward slope with a low-speed, the engine is in a high-load operating condition, and the cooling water flow passage leading to the thermosensitive portion of the thermostat is switched to a high-load side flow passage. Since the thermostat is operated in such a manner that the valve portion is opened, by means of switching the flow passage, the set temperature of the engine cooling water becomes low, and no problem arises.

However, when the engine becomes in the state of hot soak, by reason of, for example, a traffic signal, because the idling operation is in a low-load operating condition of the engine, the cooling water flow passage leading to the thermosensitive portion of the thermostat is switched to a low-load side flow passage, and the thermostat is operated in such a manner that the valve portion is closed.

For this reason, the radiating amount of the cooling water in the radiator decreases, with the result that the temperature of the cooling water begins to rise. Although such a rise in the temperature of the cooling water is not to such an extent as to overheat the engine, there may cause a problem that, if the temperature of the cooling water is maintained high (100° C. or more) for a long period of time, an adverse influence is given on the durability of the parts at the respective portions of the engine cooling apparatus.

SUMMARY OF THE INVENTION

The present invention has been made in view of the above-mentioned problem and has an object to make it possible to prevent an excessive rise in the temperature of the cooling water favorably not only in a state of a high-load operating condition of the engine but also in a state of the hot soak of the engine.

According to the present invention, a cooling apparatus for cooling a water-cooled engine by using cooling water in a cooling water circuit, includes a thermostat disposed in the cooling water circuit and having a first thermosensitive member for sensing a temperature of the cooling water and a first valve element which is displaced by the thermosensitive member, for opening or closing a water passage between a radiator and the engine, and a cooling water passage switching valve disposed in the cooling water circuit, for switching a water introducing passage for introducing the cooling water around the thermosensitive member of the thermostat. When the engine is in a high-load operating condition and when the temperature of the cooling water is equal to a predetermined value or more, the cooling water passage switching valve is controlled in such a manner that the cooling water immediately after having flowed out of the engine is introduced around the thermosensitive member of the thermostat.

Therefore, according to the present invention, both when the engine is in a high-load operating condition and when the cooling water is at a high temperature, the thermostat is operated in response to the temperature of the high temperature cooling water which has flowed out from the engine so as to shift the set temperature of the engine cooling water by the thermostat to a lower temperature.

For this reason, not only when the engine is in a high-load operating condition but also when the engine is in a state of the hot soak, it is possible to prevent an excessive rise in the temperature of the cooling water favorably.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

Embodiments of the present invention will now be described with reference to the drawings.

A first embodiment of the present invention will be described.

Figure 1:
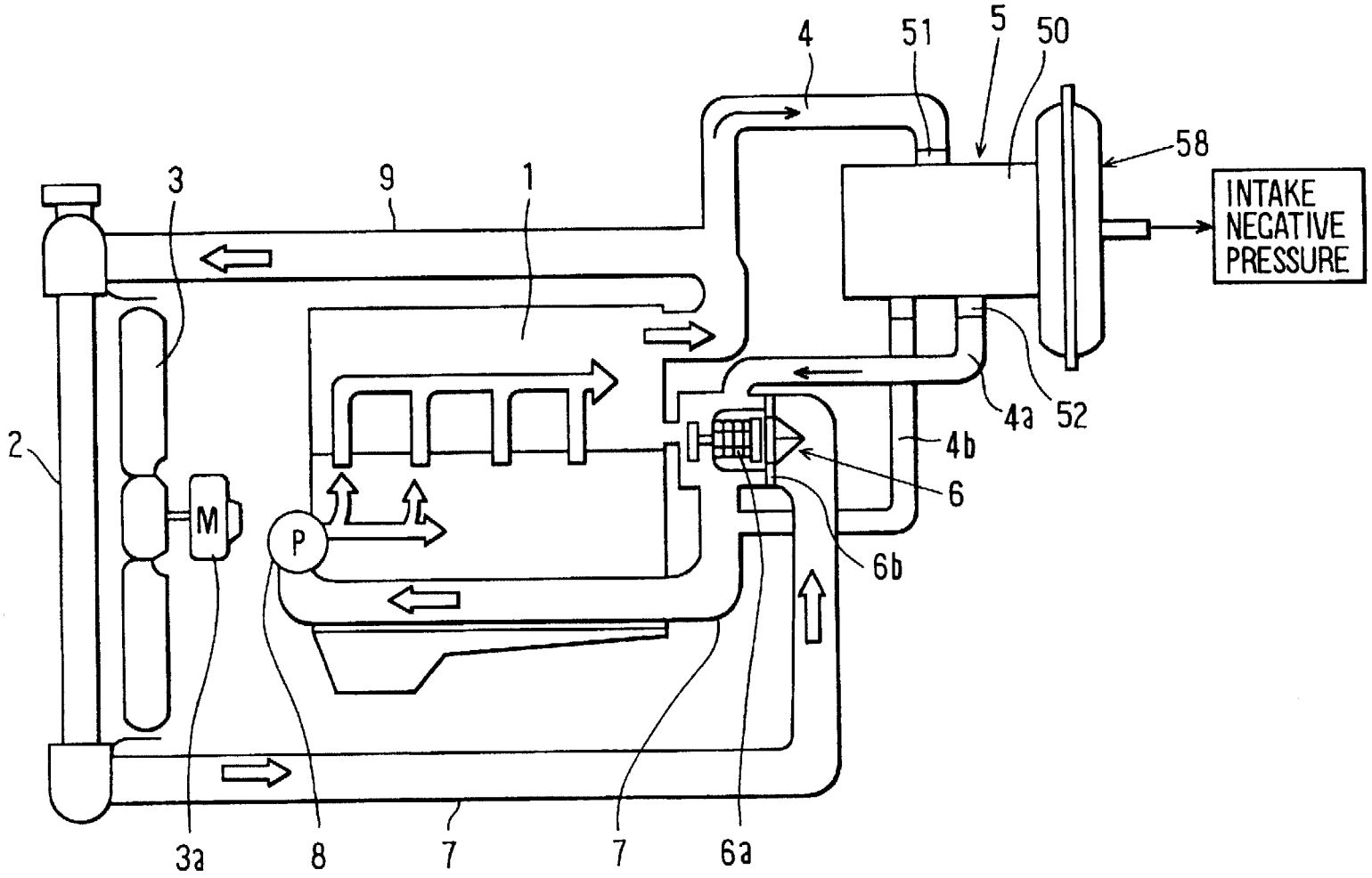
FIG. 1 is a diagram illustrating a cooling system circuit for a water-cooled engine for a vehicle according to a first embodiment of the present invention.

In FIG. 1, an engine 1 (internal combustion engine) for running a vehicle is a water-cooled engine. A radiator 2 performs heat exchange between a cooling air blown from a cooling fan 3 and a cooling water for cooling the internal combustion engine 1 to cool the cooling water. Here, the cooling fan 3 is composed of a electrically operated axial fan which is driven by a motor 3*a*.

A bypass circuit 4 is provided in parallel with the radiator 2, and the bypass circuit 4 communicates through a cooling water passage switching valve 5 with two outlet side bypass circuits 4*a* and 4*b* constituting a part of the bypass circuit 4. The detail of the cooling water passage switching valve 5 will be described later.

A thermostat 6 (cooling water temperature responsive valve) opens or closes a water passage 7 between the outlet side of the radiator 2 and the engine 1 to control the flow of the cooling water introduced to the radiator 2. The thermostat 6 has a valve element 6*b* which is displaced by a thermosensitive member 6*a* for sensing the temperature of the cooling water. The thermosensitive member 6*a* displaces the valve element 6*b* by utilizing the change in the volume of the thermo-wax due to the temperatures to open or close the water passage 7.

Specifically, when the temperature of the cooling water is low, the valve element 6*b* of the thermostat 6 closes the water passage 7 in such a manner that the cooling water flows toward the bypass circuits 4, 4*a* and 4*b*. On the other hand, when the temperature of the cooling water increases up to a predetermined value (e.g., 80° C.) or more, the thermostat 6 opens the water passage 7 on the side of the radiator 2 in such a manner that the cooling water flows toward the side of the radiator 2. Here, since the flow resistance of the cooling water flowing toward the bypass circuits 4, 4*a* and 4*b* is extremely higher than that toward the radiator 2, almost no cooling water flows toward the bypass circuit.

By opening an outlet portion of the bypass circuit 4*a* to an upstream side of the thermosensitive member 6*a* of the thermostat 6, the cooling water flows around the thermosensitive member 6*a* from the bypass circuit 4*a*. In contrast, by opening the outlet portion of the bypass circuit 4*b* to a downstream side of the thermosensitive member 6*a* of the thermostat 6, the cooling water from the bypass circuit 4*b* does not flow around the thermosensitive member 6*a* but returns directly toward the engine 1.

A water pump 8 circulates the cooling water through the cooling system circuit and is mechanically driven by the transmission of the rotation of the crank shaft of the engine 1 through a belt and pulley. A water passage 9 connects between a cooling-water outlet portion of the engine 1 and a cooling-water inlet portion of the radiator 2.

Figure 2:
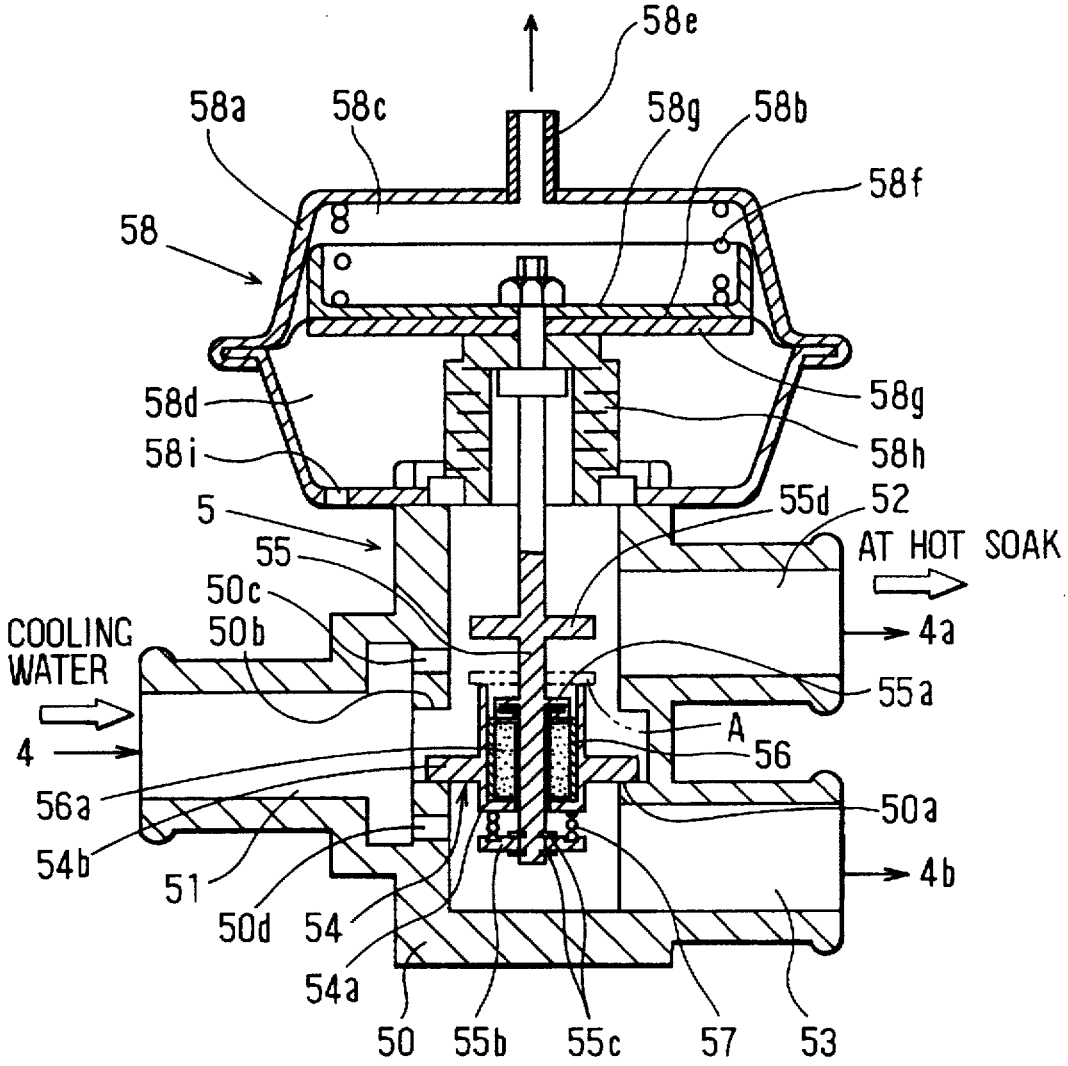
FIG. 2 is a cross sectional view illustrating a cooling water passage switching valve according to the first embodiment of the present invention.
Figure 3:
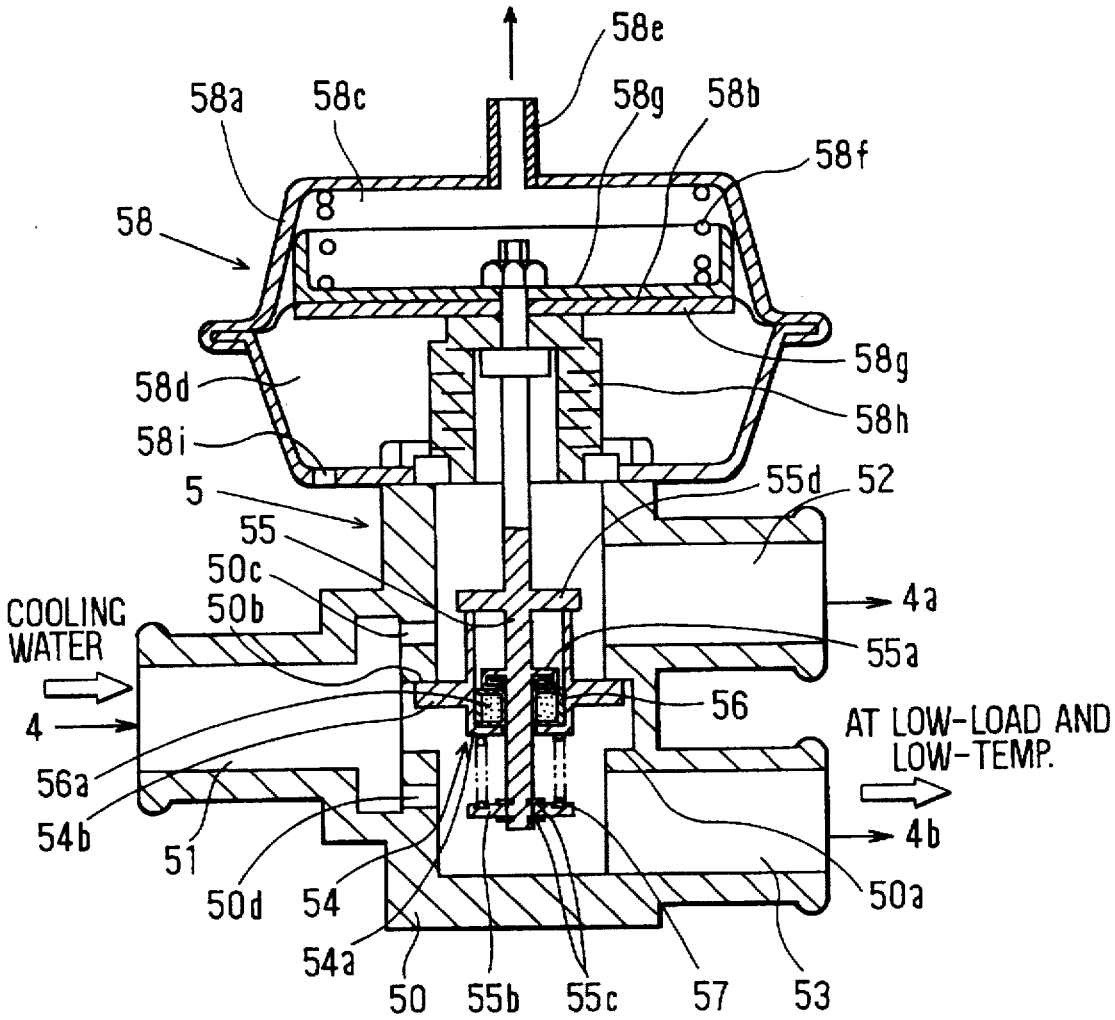
FIG. 3 is a cross sectional view illustrating the cooling water passage switching valve according to the first embodiment of the present invention in a different operation from that illustrated in FIG. 2.

FIGS. 2 and 3 illustrates a detail of the cooling water passage switching valve 5 provided with a housing 50. In the housing 50, an inlet pipe 51 to which the bypass circuit 4 is connected and outlet pipes 52 and 53 to which the bypass circuits 4*a* and 4*b* are respectively connected. A valve element 54 for switching the flow passages of the inlet pipe 51 and outlet pipe 52 is received within the housing 50 so as to be displaceable in the vertical direction of the drawing.

The valve element 54 is of a shape in which an outer peripheral surface of a cylindrical portion 54*a* having a bottom is integrally molded with a valve plate portion 54*b* which protrudes radially therefrom, and a center of a bottom surface portion of the cylindrical portion 54*a* is slidably fit with reference to a shaft 55. Within the cylindrical portion 54*a*, there is disposed a rubber-made elastic bag member (thermosensitive member) 56 in which a thermo-wax 56*a* is received. The elastic bag member 56 is fixed to an installation claw portion 55*a* which is integral with the shaft 55, at a position of the cylindrical portion 54*a* on a side opposite to the side of the bottom surface portion.

On a lower end portion of the shaft 55 there is installed a support plate 55*b* by means of an E-shaped installation ring 55*c*. Between the support plate 55*b* and the bottom surface portion of the cylindrical portion 54*a*, there is disposed a coil spring 57 for always biasing the valve element 54 upwardly in the drawing. On the shaft 55, there is integrally molded a stopper 55*d* at a position spaced by a predetermined distance from the installation claw portion 55*a* in the upward direction of the drawing. The amount of displacement of the valve element 54 toward the upward side in the drawing is regulated by this stopper 55*d*.

On one end portion of the housing 50 (the upper end portion in the drawing) there is installed a diaphragm device 58 as an actuating device for actuating the valve element 54. The interior of a casing 58*a* of this diaphragm device 58 is partitioned by a diaphragm (pressure-responsive member) 58*b* into two chambers 58*c* and 58*d*. The upper chamber 58*c* is connected to an intake manifold (not illustrated) of the engine 1 through a negative pressure introduction pipe 58*e*, so that the intake air negative pressure of the engine 1 is introduced thereinto. Within the upper chamber 58*c* there is received a coil spring 58*f* for always biasing the diaphragm 58*b* in the downward direction of the drawing. The lower chamber 58*d* is opened to the atmosphere through a small hole 58*i* formed in the casing 58*a* so as to form an atmospheric air chamber.

On front and back surfaces of the diaphragm 58*b* there are disposed pad plates 58*g*, through which the diaphragm 58*b* is connected to the other end portion (upper end portion) of the shaft 55 by means of, for example, bolting. Here, around the other end portion of the shaft 55 there is disposed a bag-shaped elastic seal member 58*h* composed of a bellows which is elastically deformable the vertical direction of the drawing. A bottom surface portion of the bag-shaped elastic seal member 58*h* (the upper end portion in the drawing) contacts with the pad plate 58*g* so as to be fixed to the other end portion of the shaft 55, with the diaphragm 58*b*. The end of the elastic seal member 58*h* on the side opposite to the bottom surface portion located (the lower end portion in the drawing) is fixed to the casing 58*a*. The bag-shaped elastic seal member 58*h* partitions the lower chamber 58*d* and the cooling water flow passage within the housing 50 while permitting the vertical movements of the shaft 55.

Within the housing 50, there are formed valve seats 50*a* and 50*b* at portions facing upper and lower surfaces of the valve element 54 respectively. On the outer sides of these valve seats 50*a* and 50*b* there are formed small communication holes 50*c* and 50*d* to mitigate the difference between the pressures acting respectively on the upper and lower sides of the valve element 54, thereby mitigating the hysteresis characteristic of the flow-passage switching action of the valve element 54. These small communication holes 50*c* and 50*d* have nothing to do with the flow-passage switching action.

Next, an operation of the cooling apparatus having the above-mentioned construction will be described. When the engine 1 is in a low-load operating condition, since the opening degree of the throttle valve (not illustrated) is low, the intake air negative pressure of the engine 1 becomes high. As a result, the diaphragm 58*b* of the cooling water passage switching valve 5 is displaced upward while resisting the spring force of the coil spring 58*f* as illustrated in FIGS. 2 and 3. For this reason, the shaft 55 is also is pulled upward in the drawing with the diaphragm 58*b*.

At a time of the hot soak such as in idling operation after the vehicle has travelled on the upward slope with a low-speed (high-load operation), there may occur a case where the temperature of the cooling water exceeds a predetermined value (e.g., 100° C.). When the temperature of the cooling water exceeds the predetermined value, the volume of the wax 56*a* within the elastic bag member 56 expands in response to the rise in temperature. Then, since the upper end portion of the elastic bag member 56 is fixed to the shaft 55, the lower end portion of the elastic bag member 56 is displaced downward and pushes the valve element 54 downward as illustrated in FIG. 2, thereby bringing the valve element 54 into pressure contact with the valve seat 50*a* of the housing 50. In this way, the water passage of the outlet pipe 53 is closed, and the inlet pipe 51 communicates with the outlet pipe 52.

Accordingly, the high temperature cooling water which has flowed out of the engine 1 flows from the bypass circuit 4 into the bypass circuit 4*a* through the flow passage located within the housing 50 and further flows into the upstream side of the thermosensitive member 6*a* of the thermostat 6. After having passed around the thermosensitive member 6*a*, the high temperature cooling water passes through the water passage 7 and is pumped by means of the water pump so as to return to the engine 1. Thus, the high temperature cooling water having flowed out of the engine 1 flows around the thermosensitive member 6*a* of the thermostat 6 so that the thermostat 6 opens the water passage 7 in response to the temperature of the high temperature cooling water.

As a result, the cooling water from the engine 1 circulates in the radiator 2 after passing through the water passages 9 and 7, and is cooled by the radiator 2.

Here, since the thermostat 6 is responsive to the temperature of the high temperature cooling water from the engine 1, the timing when the water passage 7 is opened becomes earlier than in the case where the thermostat is responsive to the temperature of the low temperature cooling water after being cooled by the radiator. As a result, since the cooling action of the radiator 2 can be performed earlier, the set temperature of the engine cooling water by the thermostat can be shifted substantially to a lower temperature (e.g., 50° C.).

As a result, even in a case of a low-load operation, by shifting the set temperature of the engine cooling water to a lower temperature at a time of the hot soak, it is possible to prevent an excessive rise in the temperature of the engine cooling water favorably.

When the engine 1 is in a low-load operating condition, if the temperature of the engine cooling water is equal to a predetermined value (e.g., 100° C.) or less, the valve element 54 of the cooling water passage switching valve 5 is displaced to a state illustrated in FIG. 3.

That is, in the low-load operating condition of the engine 1, the intake air negative pressure becomes high, and the shaft 55 is pulled upward in the drawing, with the diaphragm 58; however, since the temperature of the engine cooling water is equal to a predetermined value (e.g., 100° C.), or less, the wax 56*a* within the elastic bag member 56 is responsive to the drop in temperature and the volume of the wax 56*a* shrinks. Then, the elastic bag member 56 and valve element 54 are displaced upward while being pushed by the coil spring 57, with the result that the valve element 54 is brought into pressure contact with the upper valve seat 50*b* within the housing 50. In this way, the water passage of the outlet pipe 52 is closed, and the inlet pipe 51 communicates with the outlet pipe 53.

Accordingly, the high temperature cooling water which has flowed out of the engine 1 flows from the bypass circuit 4 into the bypass circuit 4*b* side through the water passage within the housing 50 and further flows into the downstream side of the thermosensitive member 6*a* of the thermostat 6. Therefore, the cooling water does not pass around the thermosensitive member 6*a*.

That is, the cooling water flows from the bypass circuit 4*b* directly into the water passage 7 and is pumped by the water pump 9 so as to return to the engine 1. As a result, the thermosensitive member 6*a* of the thermostat 6 cannot sense the temperature of the high temperature cooling water from the engine 1. On the other hand, the temperature of the cooling water around the thermosensitive member 6*a* is lower than that of the high temperature cooling water from the engine 1. Therefore, the timing when the water passage 7 is opened becomes delayed, the set temperature of the engine cooling water by the thermostat 6 can be shifted to a higher temperature (e.g., 100° C.), and it is possible to improve the fuel consumption by decreasing the frictional resistance of the engine 1.

In the low-load operating condition of the engine 1, the opening degree of the throttle valve increases, and the intake air negative pressure decreases. In this way, the diaphragm 58*b* and shaft 55 of the cooling water passage switching valve 5 are displaced downward in the drawing by the spring force of the coil spring 58*f*, and the stopper 55*d* integral with the shaft 55 is lowered to a position A indicated by a two-dot chain line indicated position in FIG. 2 so as to push down the valve element 54 to the position of FIG. 2 compulsorily. As a result, regardless of the temperature of the cooling water that is sensed by the wax 56*a*, the valve element 54 is brought into pressure contact with the valve seat 50*a*, and the water passage of the outlet pipe 53 is closed.

Accordingly, in the high-load operating condition of the engine 1, as at the time of the hot soak, the set temperature of the engine cooling water by the thermostat can be shifted to a lower temperature. In this way, it is possible to suppress the occurrence of a knocking and to increase the output power of the engine by improving the charge efficiency of the intake air.

A second embodiment of the present invention will be described.

Figure 4:
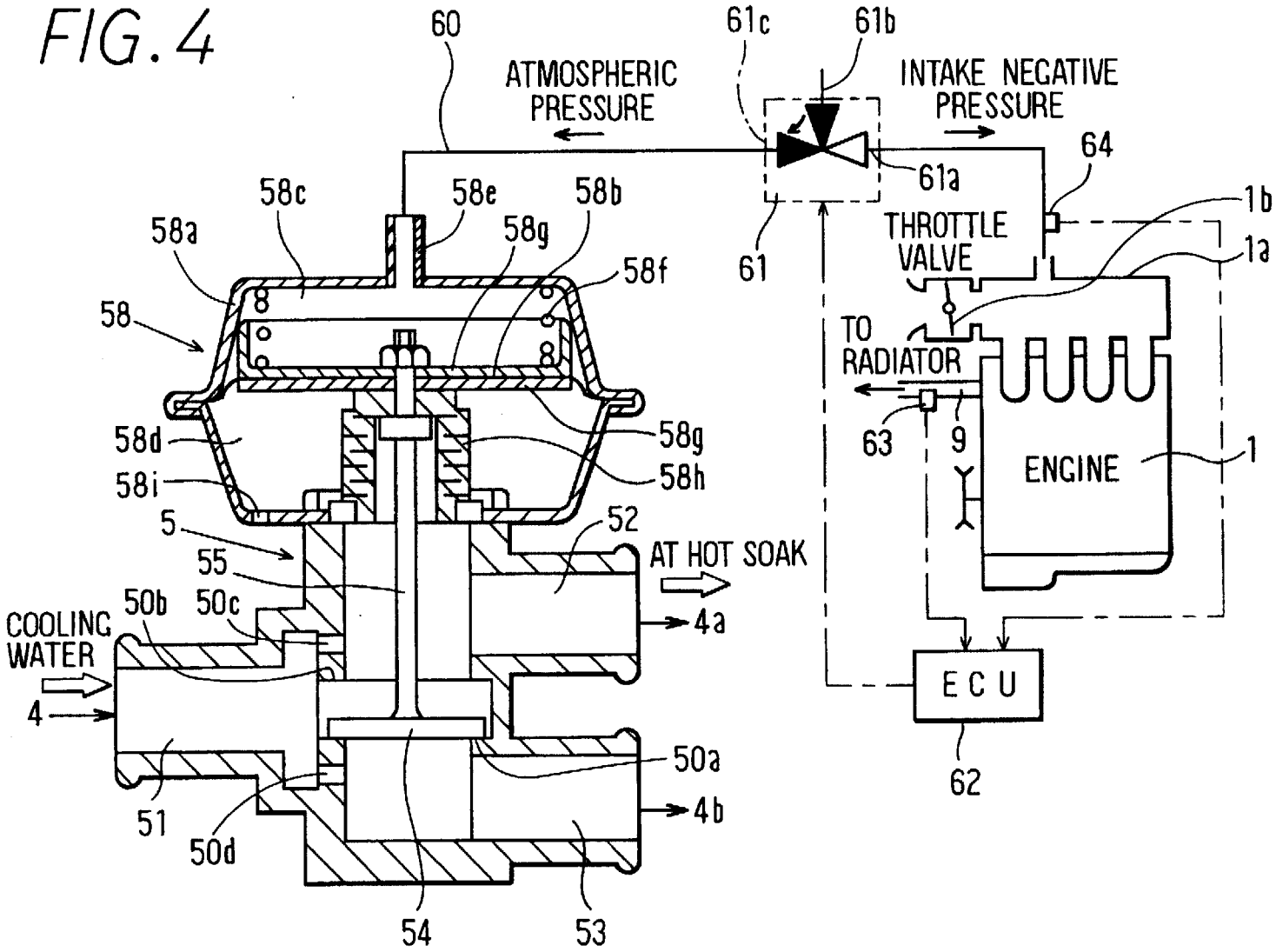
FIG. 4 is a diagram illustrating an overall construction of a cooling water passage switching valve and a control apparatus according to a second embodiment of the present invention.

FIG. 4 illustrates a second embodiment of the present invention. In this second embodiment, the valve element 54 of the cooling water passage switching valve 5 is connected directly to one end of the shaft 55, and the mechanism including the thermo-wax 56*a*, rubber-made elastic bag member 56, etc is removed.

Instead, there is provided a mechanism for electrically switching and controlling the intake air negative pressure applied to the upper chamber 58*c* of the diaphragm device 58. That is, an intake manifold 1*b* disposed on a downstream side of the throttle valve 1*a* of the engine 1 and the negative pressure introduction pipe 58*e* of the diaphragm device 58 are connected to each other by means of an air piping 60. A three-way switching valve 61 is provided in middle portion of the air piping 60.

The three-way switching valve 61 is of an electromagnetic type and selectively connects either one of a negative pressure introduction port 61*a* and an atmospheric pressure port 61*b* to an output port 61*c* to switch between the intake air negative pressure and the atmospheric pressure. The switching operation of the three-way switching valve 61 is controlled by an electronic controller 62. The electronic controller 62 is constructed using, for example, a microcomputer, and the detection signals from a temperature sensor 63 for detecting the temperature of the cooling water at a cooling-water outlet portion of the engine 1 and a pressure sensor (engine load sensor) 64 installed at an inlet portion of the air piping 60, for detecting the intake air negative pressure of the engine 1 are input to the electronic controller 62.

In the second embodiment, in a high-load operating condition of the engine 1, the intake air negative pressure decreases down to a predetermined value or less, the electronic controller 62 determines based on the detection signal from the pressure sensor 64 that the engine is in a high-load operating condition and inputs an operation signal to the three-way switching valve. In this way, the three-way switching valve 61 communicates between the atmospheric pressure port 61*b* and the output port 61*c*, and the atmospheric pressure from the atmospheric pressure port 61*b* is introduced into the chamber 58*c* of the diaphragm device 58 through the air piping 60 and the negative pressure introduction pipe 58*e*.

Then, the diaphragm 58*b* is pushed downward by the spring force of the coil spring 58*f*, and the valve element 54 is also pushed downward via the shaft 55 and brought into pressure contact with the valve seat 50*a*. Accordingly, since the water passage of the outlet pipe 53 of the cooling water passage switching valve 5 is closed and the water passage of the outlet pipe 52 is opened, the high temperature cooling water which has flowed out of the engine 1 flows around the thermosensitive member 6*a* of the thermostat 6, and the set temperature of the engine cooling water by the thermostat 6 can be shifted to a lower temperature, in the same way as in the first embodiment.

When the temperature of the engine cooling water increases up to a predetermined value or more, the electronic controller 62 determines based on the detection signal from the temperature sensor 63 that the temperature of the engine cooling water is high and inputs an operation signal to the three-way switching valve 61. As a result, the three-way switching valve 61 communicates between the atmospheric pressure port 61*b* and the output port 61*c*, and the atmospheric pressure is introduced into the chamber 58*c* of the diaphragm device 58.

As a result, the diaphragm 58*b* is pushed downward by the spring force of the coil spring 58*f*, and the valve element 54 is brought into pressure contact with the valve seat 50*a*. Therefore, the water passage of by the outlet pipe 53 of the cooling water passage switching valve 5 is closed. On the other hand, the water passage of the outlet pipe 52 is opened. Accordingly, also in this case, the high temperature cooling water which has flowed out of the engine 1 flows around the thermosensitive member 6*a* of the thermostat 6, and the set temperature of the engine cooling water by the thermostat 6 can be shifted to a lower temperature.

Although in the second embodiment the actuating device for actuating the valve element 54 of the cooling water passage switching valve 5 is constructed by a combination of the diaphragm device 58 and the three-way switching valve 61, the valve element 54 of the cooling water passage switching valve 5 may be operated by an electric actuator such as a servo motor, and such an electric actuator may be directly controlled by an operation signal from the electronic controller 62.

Additionally, there may be provided a rotation sensor for detecting a rotational speed of the engine 1, and the high temperature of the cooling water during idling operation (at the time of hot soak) may be determined from the detection signal from the rotation sensor and the detection signal from the temperature sensor 63 so as to shift the set temperature of the engine cooling water by the thermostat 6 to a lower temperature.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A cooling apparatus for cooling a water-cooled engine using cooling water, said apparatus comprising:

a cooling water circuit connected to the engine for defining a circulation path for said cooling water to and from the engine;

a radiator connected to said cooling water circuit, for cooling the cooling water;

a water pump connected to said cooling water circuit, for circulating the cooling water in said cooling water circuit;

a thermostat connected to said cooling water circuit and having a first thermosensitive member for sensing a temperature of the cooling water and a first valve element which is movable by said thermosensitive member, for opening and closing a water passage in said cooling water circuit between said radiator and said engine; and a cooling water passage switching valve connected to a portion of said cooling water circuit which receives said cooling water as said cooling water exits said engine, said cooling water passage switching valve being arranged so as to direct said cooling water from said engine toward said thermosensitive member of said thermostat when said cooling water passage switching valve is in a first switch position, wherein, said cooling water passage switching valve is responsive to engine operation, for placing said cooling water passage switch valve in said first switch position when said engine is in a high-load operating condition and when said cooling water is at a temperature which is at least equal to a predetermined value.

2. A cooling apparatus as set forth in claim 1, wherein, said cooling water passage switching valve includes:

a vacuum responsive member which is responsive to vacuum produced by said engine during intake; and a second valve element which is movable by said vacuum responsive member.

3. A cooling apparatus as set forth in claim 2, wherein, said cooling water passage switching valve includes a second thermosensitive member which is responsive to the temperature of the cooling water, and said second valve element is movable independently by each of said vacuum responsive member and said thermosensitive member.

4. A cooling apparatus as set forth in claim 3, wherein, said second thermosensitive member includes a thermowax which expands or shrinks according to the temperature of the cooling water.

5. A cooling apparatus as set forth in claim 1, further comprising:

a load sensor for detecting a load on said engine and outputting a load detection signal indicative of said load;

a temperature sensor for detecting a temperature of the cooling water and outputting a temperature detection signal indicative of said temperature; and a controller connected to said load detection signal and said temperature detection signal; and a valve actuating device connected to said controller and controlled by said controller in response to the load detection signal and the temperature detection signal, said valve actuating device switching and controlling said cooling water passage switching valve in response to the load and the temperature of the cooling water of said engine.

6. A cooling apparatus according to claim 5, wherein, said valve actuating device includes:

a pneumatic mechanism having a pressure chamber for receiving either one of a vacuum generated by said engine during intake and an atmospheric pressure, and for actuating said cooling water passage switching valve; and a switching valve for switching between application of said vacuum and application of said atmospheric pressure to said pressure chamber, according to said temperature detection signal from said temperature sensor.

7. A cooling apparatus for cooling a water-cooled engine using cooling water, said apparatus comprising:

a cooling water circuit connected to the engine and defining a circulation path for said cooling water to and from the engine;

a radiator connected to said cooling water circuit, for cooling the cooling water;

a water pump connected to said cooling water circuit, for circulating the cooling water in said cooling water circuit;

a thermostat connected to said cooling water circuit and having a first thermosensitive member for sensing a temperature of the cooling water and a first valve element which is movable by said thermosensitive member, for opening and closing a water passage in said cooling water circuit between said radiator and said engine;

a cooling water passage switching valve connected to a portion of said cooling water circuit which receives said cooling water as said cooling water exits said engine, said cooling water passage switching valve being arranged so as to direct said cooling water from said engine into a first water introducing passage which empties into a portion of said cooling water circuit directly upstream from said thermosensitive member of said thermostat when said cooling water passage switching valve is in a first switch position, said cooling water passage switching valve being further arranged so as to direct said cooling water from said engine into a second water introducing passage which empties into a section of said cooling water circuit which is downstream from said thermosensitive member of said thermostat when said cooling water passage switching valve is in a second switch position, and a control device connected to said cooling water passage switching valve and responsive to operating conditions of the engine, for controlling said cooling water passage switching valve such that, when said engine is in a high-load operating condition and when said cooling water is at a temperature at least equal to a predetermined value, said cooling water passage switching valve is in said first switch position.

8. A cooling apparatus as set forth in claim 7, wherein, said cooling water passage switching valve includes:

a vacuum responsive member responsive to a vacuum produced by said engine during intake; and a second valve element which is movable by said vacuum responsive member.

9. A cooling apparatus as set forth in claim 8, wherein, said cooling water passage switching valve includes a second thermosensitive member responsive to the temperature of the cooling water, and said second valve element is movable independently by each of said vacuum responsive member and said thermosensitive member.

10. A cooling apparatus as set forth in claim 9, wherein, said second thermosensitive member includes a thermowax which expands or shrinks according to the temperature of the cooling water.

11. A cooling apparatus according to claim 7, further comprising:

a load sensor for detecting a load on said engine and outputting a load detection signal indicative of said load; and a temperature sensor for detecting a temperature of the cooling water and outputting a temperature detection signal indicative of said temperature; wherein, said control device is connected to said load detection signal and said temperature detection signal and controls said cooling water passage switching valve in accordance with said load detection signal and said temperature signal from said load sensor and said temperature sensor.

12. A cooling apparatus according to claim 11, wherein, said load sensor detects a vacuum generated by said engine during intake.

13. A cooling apparatus according to claim 11, further comprising:

a valve actuating device controlled by said control device, for actuating said cooling water passage switching valve toward one of said first and second switch positions.

14. A cooling apparatus according to claim 13, wherein, said valve actuating device includes:

a pneumatic mechanism having a pressure chamber for receiving either one of a vacuum generated by said engine and an atmospheric pressure, and for placing said cooling water passage switching valve in one of said first and second switch positions; and a switching valve for switching between application of said vacuum and application of said atmospheric pressure to said pressure chamber, according to said temperature detection signal from said temperature sensor.

* * * * *

UNITED STATES PATENT AND TRADEMARK OFFICE

CERTIFICATE OF CORRECTION

PATENT NO. : 5,738,048

DATED : April 14, 1998

INVENTOR(S) : SUZUKI, et al.

It is certified that error appears in the above-indentified patent and that said Letters Patent is hereby corrected as shown below:

On the title page insert:

-- Item: [30] Foreign Application Priority Data -

February 6, 1996 [JP] Japan 8-20236 --.

Signed and Sealed this

Eleventh Day of August 1998

Bruce Lehman

*Attest:*

BRUCE LEHMAN

*Attesting Officer*

*Commissioner of Patents and Trademarks*